US010312596B2

(12) United States Patent
Gregoire

(10) Patent No.: US 10,312,596 B2
(45) Date of Patent: Jun. 4, 2019

(54) DUAL-POLARIZATION, CIRCULARLY-POLARIZED, SURFACE-WAVE-WAVEGUIDE, ARTIFICIAL-IMPEDANCE-SURFACE ANTENNA

(71) Applicant: HRL LABORATORIES LLC, Malibu, CA (US)

(72) Inventor: Daniel J. Gregoire, Thousand Oaks, CA (US)

(73) Assignee: HRL Laboratories, LLC, Malibu, CA (US)

( * ) Notice: Subject to any disclaimer, the term of this patent is extended or adjusted under 35 U.S.C. 154(b) by 393 days.

(21) Appl. No.: 14/310,895

(22) Filed: Jun. 20, 2014

(65) Prior Publication Data

US 2015/0372390 A1 Dec. 24, 2015

(51) Int. Cl.

| | |
|---|---|
| ***H01Q 13/20*** | (2006.01) |
| ***H01Q 13/26*** | (2006.01) |
| ***H01Q 21/24*** | (2006.01) |
| ***H01Q 15/00*** | (2006.01) |

(52) U.S. Cl.

CPC ..... *H01Q 13/206* (2013.01); *H01Q 13/20* (2013.01); *H01Q 13/26* (2013.01); *H01Q 15/006* (2013.01); *H01Q 21/24* (2013.01)

(58) Field of Classification Search

CPC ..... H01Q 13/206; H01Q 13/26; H01Q 13/20
USPC ..... 343/778, 850, 785, 909
See application file for complete search history.

(56) References Cited

U.S. PATENT DOCUMENTS 3,771,077 A * 11/1973 Tischer ..... H01Q 13/28 333/239
4,378,558 A * 3/1983 Lunden ..... H01Q 1/288 333/240
4,507,664 A * 3/1985 James ..... H01Q 21/0068 333/246
4,716,417 A 12/1987 Grumet
5,086,301 A * 2/1992 English ..... H01Q 15/242 342/188
5,486,837 A 1/1996 Miller
(Continued)

FOREIGN PATENT DOCUMENTS

EP 1 508 940 2/2005
EP 2 822 096 A1 1/2015
(Continued)

OTHER PUBLICATIONS

Young et al., "Meander-Line Polarizer," *IEEE Transactions on Antennas and Propagation*, pp. 376-378, (May 1973).
(Continued)

*Primary Examiner* — Dameon E Levi
*Assistant Examiner* — Ab Salam Alkassim, Jr.
(74) *Attorney, Agent, or Firm* — Ladas & Parry

(57) ABSTRACT

A dual-polarization, circularly-polarized artificial-impedance-surface antenna has two adjacent tensor surface-wave waveguides (SWGs), a waveguide feed coupled to each of the two SWGs and a hybrid coupler having output ports, each output port of the hybrid coupler being connected to the waveguide feeds coupled to the two SWGs, the hybrid coupler, in use, combining the signals from input ports of the 90° hybrid coupler with phase shifts at its output ports.

34 Claims, 3 Drawing Sheets

(56) References Cited

U.S. PATENT DOCUMENTS 5,638,079 A * 6/1997 Kastner ..... H01Q 13/22 343/768
5,917,458 A 6/1999 Ho et al.
6,208,316 B1 3/2001 Cahill
6,262,495 B1 7/2001 Yablonovitch et al.
6,323,826 B1 11/2001 Sievenpiper et al.
6,346,761 B1 * 2/2002 Isobe ..... H03H 9/1452 310/313 B
6,483,481 B1 11/2002 Sievenpiper et al.
6,496,155 B1 12/2002 Sievenpiper et al.
6,512,494 B1 1/2003 Diaz et al.
6,518,931 B1 2/2003 Sievenpiper
6,538,621 B1 3/2003 Sievenpiper
6,552,696 B1 4/2003 Sievenpiper et al.
6,624,781 B1 9/2003 Collins
6,628,242 B1 9/2003 Hacker et al.
6,657,592 B2 12/2003 Dening et al.
6,690,327 B2 2/2004 McKinzie et al.
6,739,028 B2 5/2004 Sievenpiper et al.
6,768,476 B2 7/2004 Lilly et al.
6,774,866 B2 8/2004 McKinzie et al.
6,806,846 B1 10/2004 West
6,897,831 B2 5/2005 McKinzie et al.
6,917,343 B2 7/2005 Sanchez et al.
7,071,888 B2 * 7/2006 Sievenpiper ..... H01Q 13/20 343/745
7,136,029 B2 11/2006 Ramprasad et al.
7,151,506 B2 12/2006 Knowles et al.
7,197,800 B2 4/2007 Sievenpiper et al.
7,215,007 B2 5/2007 McKinzie et al.
7,215,301 B2 5/2007 Choi et al.
7,218,281 B2 5/2007 Sievenpiper et al.
7,245,269 B2 7/2007 Sievenpiper et al.
7,268,650 B2 9/2007 Higgins
7,411,565 B2 8/2008 McKinzie et al.
7,420,524 B2 9/2008 Werner et al.
7,471,247 B2 12/2008 Saily et al.
7,830,310 B1 * 11/2010 Sievenpiper ..... H01Q 1/38 343/700 MS
7,911,407 B1 3/2011 Fong et al.
8,803,638 B2 8/2014 Kildal
8,847,846 B1 * 9/2014 Diaz ..... H01Q 9/27 343/700 MS
8,912,960 B1 * 12/2014 Andrenko ..... H01Q 21/0075 343/700 MS
8,982,011 B1 * 3/2015 Gregoire ..... H01Q 15/006 343/705
8,994,609 B2 * 3/2015 Gregoire ..... H01Q 13/26 343/700 MS
9,023,493 B2 * 5/2015 de Rochemont ..... C23C 24/085 428/698
2003/0112186 A1 6/2003 Sanchez
2003/0222733 A1 * 12/2003 Ergene ..... H01Q 13/0208 333/125
2004/0201526 A1 10/2004 Knowles
2005/0040918 A1 2/2005 Kildal
2005/0083228 A1 * 4/2005 Edvardsson ..... G01S 7/03 342/124
2005/0179614 A1 * 8/2005 Nagy ..... H01Q 3/24 343/909
2006/0097942 A1 * 5/2006 Tanaka ..... H01Q 15/0006 343/770
2006/0152430 A1 7/2006 Seddon et al.
2007/0001909 A1 * 1/2007 Sievenpiper ..... H01Q 15/008 343/700 MS
2007/0147723 A1 * 6/2007 Yamada ..... G02F 1/125 385/7
2007/0189666 A1 * 8/2007 Kornilovich ..... B82Y 20/00 385/30
2008/0055188 A1 * 3/2008 Lynch ..... H01Q 3/46 343/909
2009/0033586 A1 * 2/2009 Sanada ..... H01P 3/00 343/911 R
2009/0066597 A1 * 3/2009 Yang ..... H01P 3/121 343/771
2009/0152243 A1 * 6/2009 Horiguchi ..... H01J 37/32192 216/69
2009/0289737 A1 * 11/2009 Itoh ..... H01P 5/222 333/120
2010/0027130 A1 2/2010 Bowers
2010/0110559 A1 5/2010 Cai
2010/0171066 A1 7/2010 Ohkoshi
2010/0263199 A1 10/2010 Morton
2010/0265158 A1 * 10/2010 Bowers ..... G02B 27/56 343/909
2010/0271253 A1 10/2010 Shah
2011/0181373 A1 7/2011 Kildal
2011/0209110 A1 8/2011 Grbic et al.
2012/0038532 A1 2/2012 Yonetsu
2012/0194399 A1 * 8/2012 Bily ..... H01Q 13/28 343/772
2012/0206310 A1 * 8/2012 Apostolos ..... H01Q 13/28 343/771
2012/0280770 A1 * 11/2012 Abhari ..... H01P 1/184 333/209
2012/0287000 A1 * 11/2012 Ando ..... H01Q 9/0407 343/700 MS
2013/0021112 A1 * 1/2013 Apostolos ..... H01Q 1/52 333/174
2013/0214982 A1 8/2013 Dean et al.
2013/0249737 A1 * 9/2013 Gregoire ..... H01Q 13/28 343/700 MS
2013/0285871 A1 * 10/2013 Gregoire ..... H01Q 13/20 343/850
2014/0266946 A1 * 9/2014 Bily ..... H01Q 13/22 343/771
2014/0347234 A1 * 11/2014 Caloz ..... H01Q 1/38 343/756
2015/0002854 A1 * 1/2015 Laine ..... G01C 21/025 356/510
2015/0009068 A1 * 1/2015 Gregoire ..... H01Q 3/34 342/365
2015/0009070 A1 * 1/2015 Gregoire ..... H01Q 15/0066 342/372
2015/0009071 A1 * 1/2015 Gregoire ..... H01Q 3/34 342/372
2015/0123852 A1 * 5/2015 Yamagajo ..... H01Q 1/2216 343/700 MS
2015/0180133 A1 * 6/2015 Hunt ..... H01Q 15/0086 343/754
2015/0214615 A1 * 7/2015 Patel ..... H01Q 3/36 342/372
2015/0222022 A1 * 8/2015 Kundtz ..... H01Q 21/24 343/771
2015/0255870 A1 * 9/2015 Okunaga ..... H01Q 13/206 343/700 MS
2015/0276926 A1 * 10/2015 Bowers ..... G01S 13/887 342/5
2015/0318598 A1 * 11/2015 Lee ..... H01P 3/122 333/241
2015/0318621 A1 * 11/2015 Apostolos ..... H01Q 3/34 343/776
2015/0372389 A1 * 12/2015 Chen ..... H01Q 13/20 343/772
2016/0195612 A1 * 7/2016 Shi ..... G01S 7/03 342/27
2016/0329639 A1 * 11/2016 Kasahara ..... H01Q 15/0086
2017/0025765 A1 * 1/2017 Quarfoth ..... H01Q 1/36

FOREIGN PATENT DOCUMENTS

JP 2002/299951 10/2002
WO 96/09662 3/1996
WO 2004/093244 10/2004

OTHER PUBLICATIONS

International Search Report and Written Opinion (ISR & WO) for PCT/US2015/036104 dated Sep. 22, 2015.

(56) References Cited

OTHER PUBLICATIONS

From U.S. Appl. No. 13/744,295 (Unpublished, Non Publication Requested), Notice of Allowance dated Sep. 16, 2015.
U.S. Appl. No. 13/744,295, filed Jan. 17, 2013
A.M Patel, A. Grbic, "A Printed Leaky-Wave Antenna Based on a Sinusoidally-Modulated Reactance Surface," IEEE Transactions on Antennas and Propagation, vol. 59, No. 6, pp. 2087-2096, (Jun. 2011).
D. Sievenpiper et al, "Holographic Artificial Impedance Surfaces for Conformal Antennas", 29th Antennas Applications Symposium, (10 pp), 2005.
D. Sievenpiper et al. "Holographic Artificial Impedance Surfaces for Conformal Antennas" 2005 IEEE Antennas and Prop. Symp. Digest, vol. 1B, pp. 256-259, 2005.
D.J. Gregoire and J.S. Colburn, "Artificial Impedance Surface Antennas", Proc. Antennas Application Symposium, pp. 460-475, (2011).
D.J. Gregoire and J.S. Colburn, "Artificial Impedance Surface Antenna Design and Simulation," Proc. Antennas Application Symposium, pp. 288-303, (2010).
D.J. Gregoire and A.V. Kabakian, "Surface-Wave Waveguides," IEEE Antennas and Wireless Propagation Letters, vol. 10, pp. 1512-1515, (2011).
O. Luukkonen, C. Simovski, G. Granet, G. Goussetis, D. Lioubtchenko, A.V. Räisänen, S.A. Tretyakov, "Simple and Accurate Analytical Model of Planar Grids and High-Impedance. Surfaces Comprising Metal Strips or Patches," IEEE Transactions on Antennas and Propagation, vol. 56, No. 6, pp. 1624-1632, (Jun. 2008).
B.H. Fong, J.S. Colburn, J.J Ottusch, J.L. Visher, D.F. Sievenpiper, "Scalar and Tensor Holographic Artificial Impedance Surfaces" IEEE Transactions on Antennas and Propagation, vol. 58, No. 10, pp. 3212-3221, (Oct. 2010).
http://www.microwaves101.com/encyclopedia/hybridcouplers.cfm, retrieved Jun. 10, 2014, (6 pages).
From U.S. Appl. No. 13/744,295 (unpublished; non-publication request filed), Final Office Action dated May 5, 2015.
From U.S. Appl. No. 13/744,295 (unpublished; non-publication request filed), Non-Final Office Action dated Oct. 16, 2014.
U.S. Appl. No. 14/310,895, Gregoire, Daniel J.
Bilow, Henry J., "Guided Waves on a Planar Tensor Impedance Surface," *IEEE Transactions on Antennas and Propagation*, vol. 51, No. 10, pp. 2788-2792, (Oct. 2003).
Canino et al., "Numerical Solution of the Helmholtz Equation in 2D and 3D Using a High-Order Nystrom Discretization," *Journal of Computational Physics*, vol. 146, pp. 627-663, (1998).
Checcacci et al., "Holographic Antennas," *IEEE Transactions on Antennas and Propagation*, vol. 18, No. 6, pp. 811-813, (Nov. 1970).
Contopanagos et al., Well-Conditioned Boundary Integral Equations for Three-Dimensional Electromagnetic Scattering, *IEEE Transactions on Antennas and Propagation*, vol. 50, No. 12, pp. 1824-1830, (Dec. 2002).
Fathy et al., "Silicon-Based Reconfigurable Antennas—Concepts, Analysis, Implementation, and Feasibility," *IEEE Transactions on Microwave Theory and Techniques*, vol. 51, No. 6, pp. 1650-1661, (Jun. 2003).
Kabakian, Adour, "Tensor Impedance Surfaces," AFOSR Final Report, (Nov. 30, 2010). http://www.dtic.mil/cgi-bin/GetTRDoc?AD=ADA566251.
King et al., "The Synthesis of Surface Reactance Using an Artificial Dielectric," *IEEE Transactions on Antennas and Propagation*, vol. 31, No. 3, pp. 471-476, (May 1993).
Levis et al., "Ka-Band Dipole Holographic Antennas," *IEEE Proceedings of Microwaves, Antennas and Propagation*, vol. 148, No. 2, pp. 129-132, (Apr. 2001).
Mitra et al., "Techniques for Analyzing Frequency Selective Surfaces—A Review," *Proceedings of the IEEE*, vol. 76, No. 12, pp. 1593-1615, (Dec. 1988).
Oliner et al., "Guided Waves on Sinusoidally-Modulated Reactance Surfaces," *IRE Transactions on Antennas and Propagation*, vol. 7, No. 5, pp. S201-S208, (Dec. 1959).
Patel, A. M., and Grbic, A., "Modeling and Analysis of Printed-Circuit Tensor Impedance Surface," *IEEE Transactions on Antennas and Propagation*, vol. 61, No. 1, pp. 211-220, (Jan. 2013).
Patel, A. M., and Grbic, A., "Effective Surface Impedance of a Printed-Circuit Tensor Impedance Surface," *IEEE Transactions on Microwave Theory and Techniques*, vol. 61, No. 4, pp. 1403-1413, (Apr. 2013).
Patel, A. M., and Grbic, A., "Transformation Electromagnetics Devices Using Tensor Impedance Surfaces," *IEEE International Microwave Symposium*, (2013).
Patel, A. M., and Grbic, A., "The Effects of Spatial Dispersion on Power Flow Along a Printed-Circuit Tensor Impedance Surface," *IEEE Transactions on Antennas and Propagation*, vol. 62, No. 3, (Mar. 2014).
Pease, Robert L., "Radiation From Modulated Surface-Wave Structures—II," *IRE International Convention Record*, vol. 5, pp. 161-165, (Mar. 1957).
Pendry, J. B. et al., "Controlling Electromagnetic Fields," *Science*, vol. 312, No. 5781, pp. 1780-1782, (Jun. 23, 2006).
Sazonov, Dimitry M., "Computer Aided Design of Holographic Antennas," *IEEE International Symposium of the Antennas and the Propagation Society*, vol. 2, pp. 738-741, (Jul. 1999).
ElSherbiny et al., "Holographic Antenna Concept, Analysis, and Parameters," *IEEE Transactions on Antennas and Propagation*, vol. 52, No. 3, pp. 830-839 (Mar. 2004).
Sievenpiper et al., "High-Impedance Electromagnetic Surfaces with a Forbidden Frequency Band," *IEEE Transactions on Microwave Theory and Techniques*, vol. 47, No. 11, pp. 2059-2074, (Nov. 1999).
Thomas et al., "Radiation From Modulated Surface Wave Structures—I," *IRE International Convention Record*, vol. 5, pp. 153-160, (Mar. 1957).
Visher et al., "Polarization Controlling Holographic Artificial Impedance Surfaces," *IEEE AP-S*, 2007.
From Japanese Application No. 2008/519484 Final Office Action, Decision of Refusal dated Oct. 11, 2011 with English Translation.
From PCT Application No. PCT/US2006/024979, International Search Report and Written Opinion (ISR & WO) dated Nov. 21, 2006.
From PCT Application No. PCT/US2006/024979, Chapter I, International Preliminary Report on Patentability (IPRP) dated Jan. 9, 2008.
From PCT Application No. PCT/US2006/024980, International Search Report and Written Opinion (ISR & WO) dated on Nov. 29, 2006.
From PCT Application No. PCT/US2006/024980, International Preliminary Report on Patentability (IPRP) dated Jul. 2, 2008.
From Taiwanese Application No. 95123303, ROC Office Action, Non Final Rejection dated Mar. 20, 2012 with English Translation.
From Taiwanese Application No. 95123303, ROC Office Action, additional Non Final Rejection dated Mar. 20, 2012 with English Translation.
From Taiwanese Application No. 95123303, ROC Office Action, Decision to Reject dated Jun. 27, 2012 with English Translation.
From United Kingdom Application No. GB0800954.0, UK Office Action dated Dec. 5, 2008.
From United Kingdom Application No. GB0722887.7, UK Office Action dated Dec. 4, 2008.
From U.S. Appl. No. 11/173,182 (Now U.S. Pat. No. 7,830,310), Non-Final Rejection dated May 16, 2006.
From U.S. Appl. No. 11/173,182 (Now U.S. Pat. No. 7,830,310), Restriction/Election dated Jan. 10, 2007.
From U.S. Appl. No. 11/173,182 (Now U.S. Pat. No. 7,830,310), Final Rejection dated Apr. 30, 2007.
From U.S. Appl. No. 11/173,182 (Now U.S. Pat. No. 7,830,310), Non-Final Rejection dated Aug. 15, 2007.
From U.S. Appl. No. 11/173,182 (Now U.S. Pat. No. 7,830,310), Non-Final Rejection dated Feb. 4, 2008.
U.S. Appl. No. 11/173,182 (Now U.S. Pat. No. 7,830,310), Non-Final Rejection dated Jul. 30, 2008.

(56) References Cited

OTHER PUBLICATIONS

From U.S. Appl. No. 11/173,182 (Now U.S. Pat. No. 7,830,310), Final Rejection dated Dec. 9, 2008.
From U.S. Appl. No. 11/173,182 (Now U.S. Pat. No. 7,830,310), Requirement/Election dated Apr. 23, 2009.
From U.S. Appl. No. 11/173,182 (Now U.S. Pat. No. 7,830,310), Non-Final Rejection dated Aug. 14, 2009.
From U.S. Appl. No. 11/173,182 (Now U.S. Pat. No. 7,830,310), Final Rejection dated Jan. 28, 2010.
From U.S. Appl. No. 11/173,182 (Now U.S. Pat. No. 7,830,310), additional Final Rejection dated Jan. 28, 2010.
From U.S. Appl. No. 11/173,182 (Now U.S. Pat. No. 7,830,310), Notice of Allowance dated Jul. 22, 2010.
From U.S. Appl. No. 11/173,187 (Now U.S. Pat. No. 7,218,281), Non-Final Rejection dated May 31, 2006.
From U.S. Appl. No. 11/173,187 (Now U.S. Pat. No. 7,218,281), Notice of Allowance dated Jan. 9, 2007.
From U.S. Appl. No. 11/173,187 (Now U.S. Pat. No. 7,218,281), additional Notice of Allowance dated Jan. 9, 2007.
From U.S. Appl. No. 12/138,083 (Now U.S. Pat. No. 7,911,407), Non-Final Rejection dated Aug. 2, 2010.
From U.S. Appl. No. 12/138,083 (Now U.S. Pat. No. 7,911,407), Notice of Allowance dated Nov. 15, 2010.
From U.S. Appl. No. 14/310,895, filed Jun. 20, 2014; Unpublished, Non Publication Requested), Application and Office Actions.
From U.S. Appl. No. 14/737,100 (unpublished; non publication request filed), Office Action dated Feb. 23, 2018.
Extended European Search Report and Search Opinion from European Patent Application No. 15810252.5 dated Jan. 8, 2018.
Dong, Yuandan et al.: "Substrate Integrated Composite Right-/Left-Handed Leaky-Wave Structure for Polarization-Flexible Antenna Application", IEEE Transactions on Antennas and Propagation, IEEE Service Center, Piscataway, NJ, US, vol. 60, No. 2, Feb. 1, 2012 (Feb. 1, 2012), pp. 760-771.
Patel, Amit M.: "Controlling Electromagnetic Surface Waves with Scalar and Tensor Impedance Surfaces", Jan. 1, 2013, <https://deepblue.lib.umich.edu/bitstream/handle/2027.42/97954/amitmpl.pdf?sequence=1&isAllowed=y> (retrieved on Dec. 20, 2017); pp. 1-180.
U.S. Appl. No. 14/737,100, filed Jun. 11, 2015, Patel.
From: U.S. Appl. No. 14/737,100 (unpublished; non publication requested filed), Office Action dated Sep. 5, 2017.
PCT International Preliminary Report on Patentability (Chapter II) from PCT/US2015/036104 dated Jun. 16, 2016.
"Hybrid (3 dB) Couplers," Microwaves101: Microwave Encyclopedia. P N Designs, Inc. and IEEE. May 7, 2013. Web. 10th http://www.microwaves101.com/encyclopedia/hybridcouplers.cfm, retrieved Jun. 10, 2014, (6 pages).
U.S. Appl. No. 15/986,741, filed May 22, 2018, Patel.
U.S. Appl. No. 15/344,363, filed Nov. 4, 2016, Patel.
Office action from Chinese Patent Application No. 201580024969.5 dated Sep. 20, 2018 with Search Report and its English translation.
Office action from European Patent Application No. 15810252.5 dated Dec. 14, 2018.

* cited by examiner

DUAL-POLARIZATION, CIRCULARLY-POLARIZED, SURFACE-WAVE-WAVEGUIDE, ARTIFICIAL-IMPEDANCE-SURFACE ANTENNA

CROSS REFERENCE TO RELATED APPLICATIONS

This application is related to U.S. patent application Ser. No. 13/744,295 filed Jan. 17, 2013 and entitled "Surface Wave Guiding Apparatus and Method", the disclosure of which is hereby incorporated herein by reference.

STATEMENT REGARDING FEDERALLY SPONSORED RESEARCH OR DEVELOPMENT

None.

TECHNICAL FIELD

This invention provides an antenna capable of dual-polarization, circularly-polarized simultaneous Right Hand Circular Polarization (RHCP) and Left Hand Circular Polarization (LHCP) operation.

BACKGROUND

Linearly-polarized AIS Antennas

Artificial impedance surface antennas (AISAs) are realized by launching a surface wave across an artificial impedance surface (AIS), whose impedance is spatially modulated across the AIS according a function that matches the phase fronts between the surface wave on the AIS and the desired far-field radiation pattern.

In the prior art, an artificial impedance surface antenna (AISA) is formed from modulated artificial impedance surfaces (AIS). The prior art, in this regard, includes:

(1) Patel (see, for example, Patel, A. M.; Grbic, A., "*A Printed Leaky-Wave Antenna Based on a Sinusoidally-Modulated Reactance Surface", IEEE Transactions on Antennas and Propagation*, vol. 59, no. 6, pp. 2087-2096, June 2011) demonstrated a scalar AISA using an endfire-flare-fed one-dimensional, spatially-modulated AIS consisting of a linear array of metallic strips on a grounded dielectric.

(2) Sievenpiper, Colbum and Fong (see, for example, D. Sievenpiper et al, "*Holographic AISs for conformal antennas*", 29th Antennas Applications Symposium, 2005 & 2005 IEEE Antennas and Prop. Symp. Digest, vol. 1B, pp. 256-259, 2005; and B. Fong et al, "*Scalar and Tensor Holographic Artificial Impedance Surfaces*", IEEE TAP., 58, 2010) have demonstrated scalar and tensor AISAs on both flat and curved surfaces using waveguide-fed or dipole-fed, two-dimensional, spatially-modulated AIS consisting of a grounded dielectric topped with a grid of metallic patches.

(3) Gregoire (see, for example, D. J. Gregoire and J. S. Colbum, "*Artificial impedance surface antennas*", Proc. Antennas Appl. Symposium 2011, pp. 460-475; D. J. Gregoire and J. S. Colbum, "*Artificial impedance surface antenna design and simulation*", Proc. Antennas Appl. Symposium 2010, pp. 288-303) has examined the dependence of AISA operation on its design properties.

The basic principle of AISA operation is to use the grid momentum of the modulated AIS to match the wavevector of an excited surface-wave front to a desired plane wave. In the one-dimensional case, this can be expressed as $$k_{sw}=k_o \sin \theta_o - k_p, \quad \text{(Eqn. 1)}$$

where $k_o$ is the radiation's free-space wavenumber at the design frequency, $\theta_o$ is the angle of the desired radiation with respect to the AIS normal, $k_p=2\pi/p$ is the AIS grid momentum where p is the AIS modulation period, and $k_{sw}=n_o k_o$ is the surface wave's wavenumber, where $n_o$ is the surface wave's refractive index averaged over the AIS modulation. The Surface Wave (SW) impedance is typically chosen to have a pattern that modulates the SW impedance sinusoidally along the Surface Wave Guide (SWG) according to the following equation:

$$Z(x)=X+M\cos(2\pi x/p) \quad \text{(Eqn. 2)}$$

where p is the period of the modulation, X is the mean impedance, and M is the modulation amplitude. X, M and p are chosen such that the angle of the radiation θ in the x-z plane w.r.t the z axis is determined by $$\theta=\sin^{-1}(n_0-\lambda_0/p) \quad \text{(Eqn. 3)}$$

where $n_0$ is the mean SW index and $\lambda_0$ is the free-space wavelength of radiation. $n_0$ is related to Z(x) by $$n_0=\frac{1}{p}\int_0^p \sqrt{1+Z(x)^2}\,dx \approx \sqrt{1+X^2}.$$

The AISA impedance modulation of Eqn. 2 can be generalized for an AISA of any shape as $$Z(\vec{r})=X+M\cos(k_o n_o r-\vec{k}_o\cdot\vec{r})$$

where $\vec{k}_o$ is the desired radiation wave vector, $\vec{r}$ is the three-dimensional position vector of the AIS, and r is the distance along the AIS from the surface-wave source to $\vec{r}$ along a geodesic on the AIS surface. This expression can be used to determine the index modulation for an AISA of any geometry, flat, cylindrical, spherical, or any arbitrary shape. In some cases, determining the value of r is geometrically complex. For a flat AISA, it is simply $r=\sqrt{x^2+y^2}$.

For a flat AISA designed to radiate into the wavevector at $\vec{k}_o=k_o(\sin\theta_o\hat{x}+\cos\theta_o\hat{z})$, with the surface-wave source located at x=y=0, the modulation function is $$Z(x,y)=X+M\cos\gamma$$

$$\text{where } \gamma=k_0(n_0 r-x\sin\theta_0). \quad \text{(Eqn. 4)}$$

The cos function in Eqn. 2 and Eqn. 3 can be replaced with any periodic function and the AISA will still operate as designed, but the details of the side lobes, bandwidth and beam squint will be affected.

The AIS can be realized as a grid of metallic patches disposed on a grounded dielectric that produces the desired index modulation by varying the size of the patches according to a function that correlates the patch size to the surface wave index. The correlation between index and patch size can be determined using simulations, calculation and/or measurement techniques. For example, Colburn and Fong (see references cited above) use a combination of HFSS unit-cell eigenvalue simulations and near field measurements of test boards to determine their correlation function. Fast approximate methods presented by Luukkonen (see, for example, O. Luukkonen et al, "Simple and accurate analytical model of planar grids and high-impedance surfaces comprising metal strips or patches", IEEE Trans. Antennas Prop., vol. 56, 1624, 2008) can also be used to calculate the correlation. However, empirical correction factors are often applied to these methods. In many regimes, these methods agree very well with HFSS eigenvalue simulations and near-field measurements. They break down when the patch size is large compared to the substrate thickness, or when the surface-wave phase shift per unit cell approaches 180°.

Circularly-polarized AIS Antennas

An AIS antenna can be made to operate with circularly-polarized (CP) radiation by using an impedance surface whose impedance properties are anisotropic. Mathematically, the impedance is described at every point on the AIS by a tensor. In a generalization of the modulation function of equation (3) for the linear-polarized AISA [4], the impedance tensor of the CP AISA may have a form like $$Z = \begin{bmatrix} X - M\cos\phi\cos\gamma & \frac{1}{2}M\sin(\gamma-\phi) \\ \frac{1}{2}M\sin(\gamma-\phi) & X + M\sin\phi\sin\gamma \end{bmatrix}; \quad \text{(Eqn. 5)}$$

$$\text{where } \tan\phi \equiv \frac{y}{x}. \quad \text{(Eqn. 6)}$$

In the article by B. Fong et al. identified above, the tensor impedance is realized with anisotropic metallic patches on a grounded dielectric substrate. The patches are squares of various sizes with a slice through the center of them. By varying the size of the patches and the angle of the slice through them, the desired tensor impedance of equation Eqn. 5 can be created across the entire AIS. Other types of tensor impedance elements besides the "sliced patch" can be used to create the tensor AIS.

Surface-wave Waveguide AIS Antennas

A variation on the AIS antennas utilizes surface-wave waveguides to confine the surface waves along narrow paths that form one-dimensional ES AISAs. Surface-wave waveguides (SWG) are surface structures that constrain surface-waves (SW) to propagate along a confined path (see, for example, D. J. Gregoire and A. V. Kabakian, "*Surface-Wave Waveguides*," Antennas and Wireless Propagation Letters, IEEE, 10, 2011, pp. 1512-1515). In the simplest SWG, the structure interacts with surface waves in the same way that a fiber-optic transmission line interacts with light. The physical principle is the same: the wave preferentially propagates in a region of high refractive index surrounded by a region of low refractive index. In the case of the fiber optic, or any dielectric waveguide, the high- and low-index regions are realized with high and low-permittivity materials. In the case of the SWG, the high- and low-index regions can be realized with metallic patches of varying size and/or shape on a dielectric substrate.

The surface-wave fields across the width of the SWG are fairly uniform when the width of the SWG is less than approximately ¾ surface-wave wavelength. So, this is a good rule of thumb for the SWG.

In a linearly-polarized SWG AISA, the impedance of the SWG varies according to equation Eqn. 2. The impedance elements can be square patches of metal on the substrate or they can be strips that span the width of the SWG. The desired impedance modulation is created by varying the size of the impedance element dimensions with position.

In a circularly-polarized SWG, the tensor impedance varies according to equation Eqn. 5 with $\phi=0$. The impedance elements can be the sliced patches as described by B. Fong et al. (see the B. Fong et al. article referenced above). The impedance element dimensions are varied with position to achieve the desired impedance variation.

BRIEF DESCRIPTION OF THE INVENTION

In one aspect the present invention provides a dual-polarization, circularly-polarized artificial-impedance-surface antenna comprising: (1) two adjacent tensor surface-wave waveguides (SWGs); (2) a waveguide feed coupled to each of the two SWGs; (3) a hybrid coupler (which is preferably a 90° coupler) having output ports, each output port of the hybrid coupler being connected to the waveguide feeds coupled to the two SWGs, the hybrid coupler, in use, combining the signals from input ports of the hybrid coupler with phase shifts at its output ports.

In another aspect the present invention provides a method of simultaneously transmitting two oppositely handed circularly polarized RF signals comprising the steps of: (i) providing a dielectric surface with a ground plane on one side there of and with a pair of elongate artificial impedance surface antennas, each of said artificial impedance surface antennas including a pattern of metallic geometric stripes or shapes disposed on said dielectric surface, the metallic geometric stripes or shapes having varying sizes which form a repeating moire pattern, the moire patterns of the each of said pair of elongate artificial impedance surface antennas having a angular relationship with reference to a major axis of said pair of elongate artificial impedance surface antennas, a first one of said pair of elongate artificial impedance surface antennas having a positive angular relationship to said major axis and second one of said pair of elongate artificial impedance surface antennas having a negative angular relationship to said major axis; and (ii) applying RF energy to said pair of elongate artificial impedance surface antennas, said RF energy applied to said pair of elongate artificial impedance surface antennas having different relative phases selected such that RF signals transmitted by said pair of elongate artificial impedance surface antennas is circularly polarized.

In yet another aspect the present invention provides a method of simultaneously receiving two oppositely handed circularly polarized RF signals comprising the steps of: (i) sending the signals received by two SWGs into two input ports of a 3 dB 90 degree hybrid coupler, the coupler also having two output ports; and (ii) extracting LHCP and RHCP signals from the output two ports of the hybrid coupler.

BRIEF DESCRIPTION OF THE DRAWINGS

FIG. 1*a* is top view of one embodiment of the present invention disposed on a printed circuit broad while

DETAILED DESCRIPTION

This invention provides a solution for a dual-polarization, circularly-polarized AISA with simultaneous Right Hand Circular Polarization (RHCP) and Left Hand Circular Polarization (LHCP) operation.

Figure 1A:
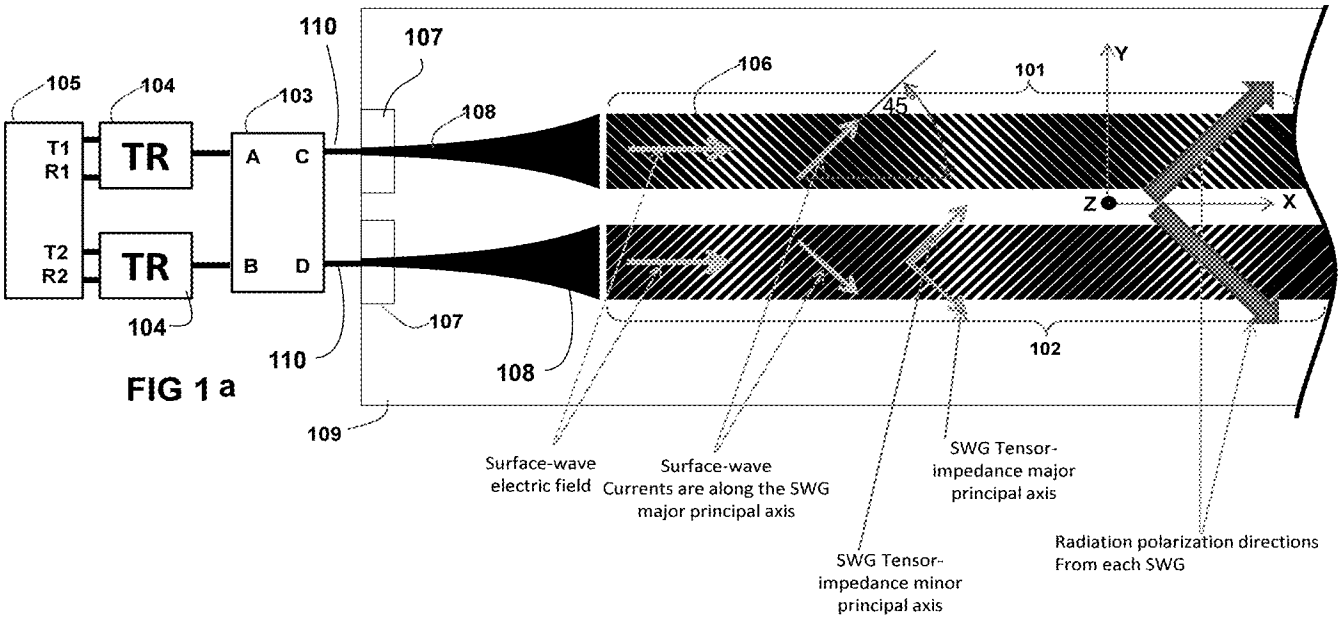
Figure 1B:
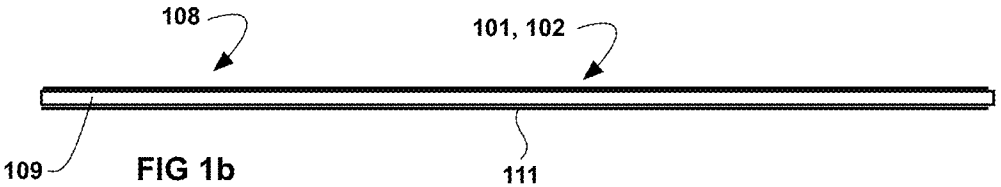
FIG. 1*b* is a side elevational view thereof.

Referring to FIGS. 1*a* and 1*b*, one possible embodiment of the invention includes a pair of linearly-polarized SWGs 101 and 102 to form the AISA. The polarization of the two SWGs 101, 102 is preferably rotated by 90° with respect to each other. The SWGs 101, 102 are connected to ports C and D of a 3-dB 90° hybrid coupler 103, the operation of which is well understood in the state of the art (see, for example, www.microwaves101.com/encyclopedia/hybridcoupler-s.cfm). The signals at ports C and D are the sum of the signals at ports A and B with preferably either a 90° or a −90° phase shift between them, respectively. The combination of the radiation from the two SWGs 101, 102 with the 90° rotation in polarization and the 90° separation in phase results in circularly polarized radiation. It is well known that circularly polarized radiation can be created by combining radiation from two antennas with orthogonal polarization with a 90° phase shift between them. The signal connected to port A is transmitted or received with RHCP polarization while the signal connected to port B simultaneously is transmitted or received with LHCP polarization. Transmit-Receive (TR) switches 104 enable independent operation of each polarization in transmit or receive modes depending on the positions of switches 104. The two channels are processed in receive mode by conventional front-end electronics 105 and the two channels are provided in transmit mode with transmit signals again by conventional front-end electronics 105. The conventional front-end electronics 105 may be embodied in or by a transceiver with dual inputs (R1 and R2) and dual outputs (T1 and T2) or in or by separate transmitters and receivers or in or by a RF transmit/receive module.

Figure 2:
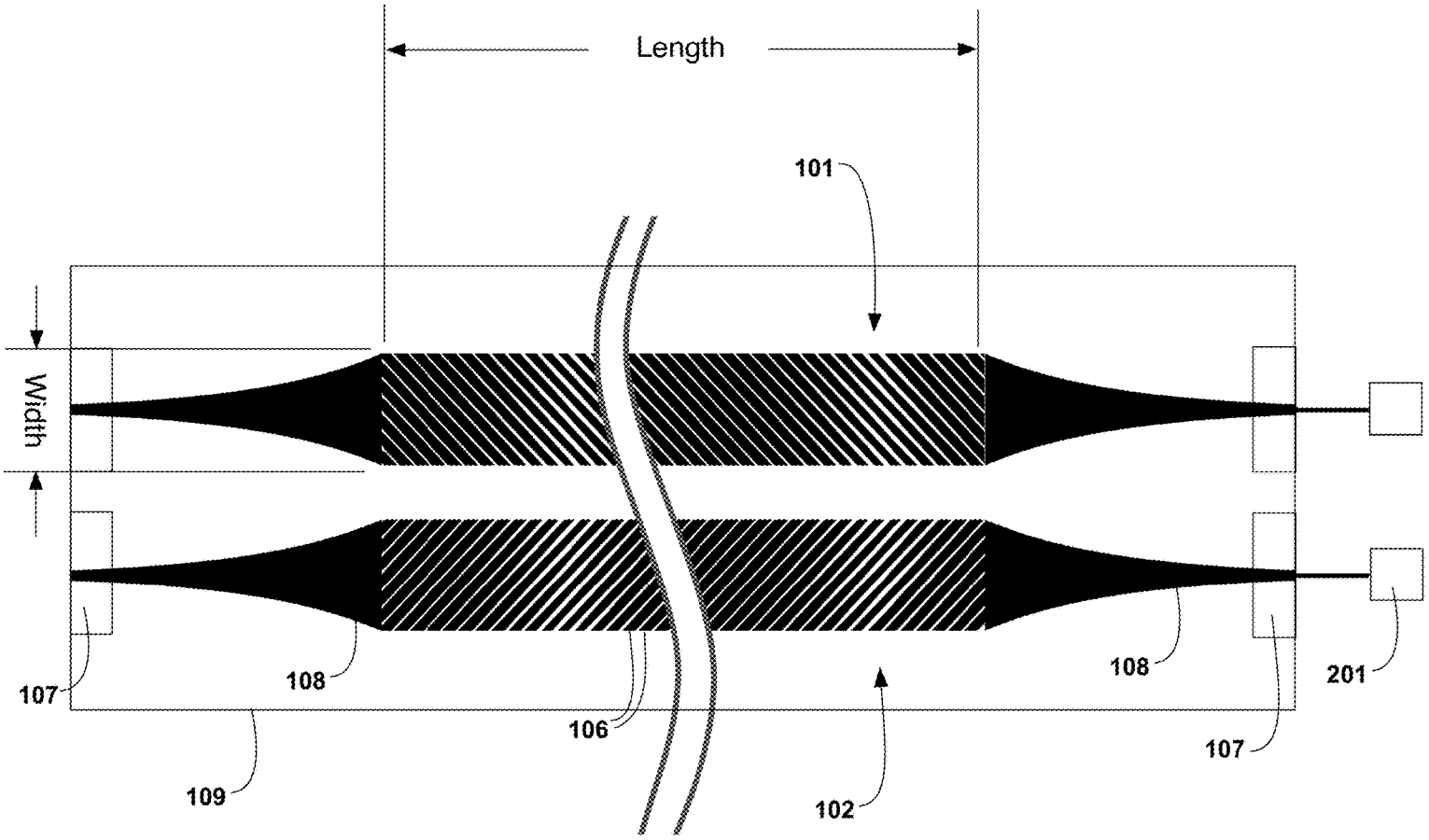
FIG. 2 is a schematic view of another embodiment of a SWG which may be used with the present invention.
Figure 3:
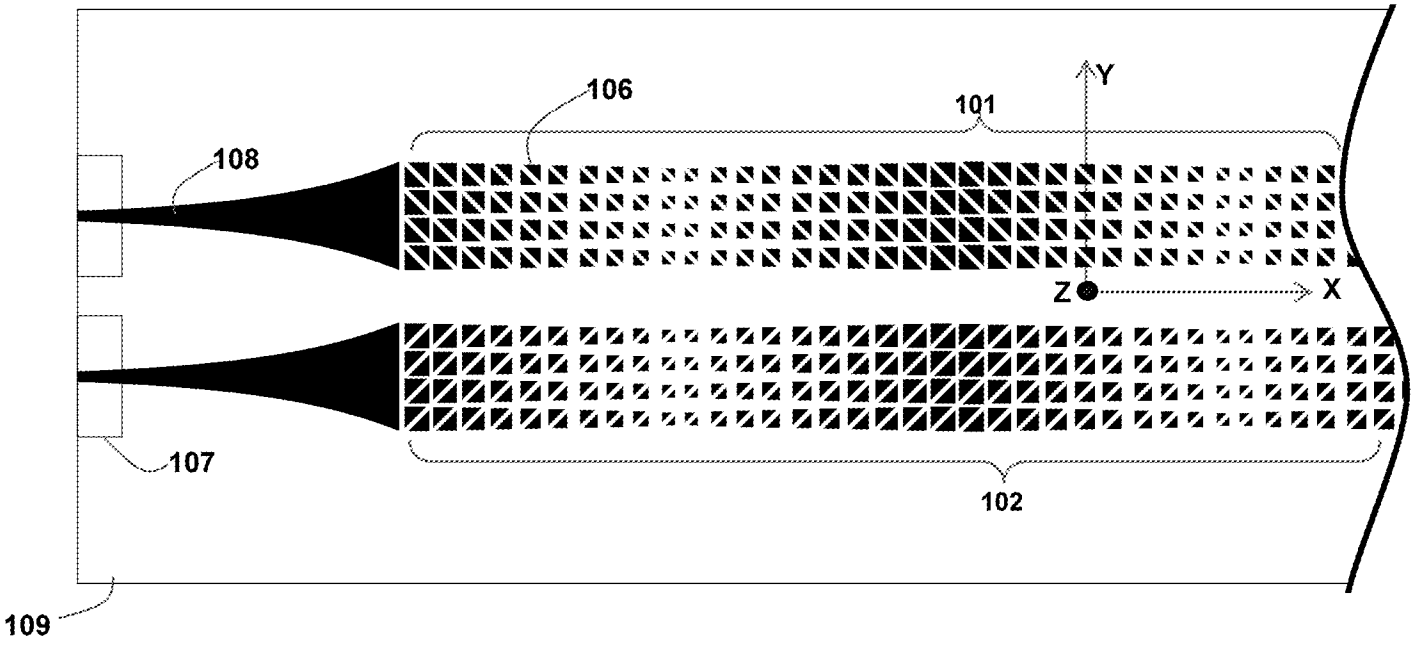
FIG. 3 is a schematic view of yet another embodiment of a SWG which may be used with the present invention.

Each of the SWGs 101, 102 is a linear array of tensor impedance elements 106 that radiate with a polarization preferably at a ±45° angle to the polarization of the SW electric field (in the x axis labeled in FIG. 1, the x axis also being the major axis or axis of common elongation of the two SWGs 101, 102). The tensor elements 106 are preferably metallic shapes printed or otherwise formed on the top surface of a dielectric substrate 109 which preferably has a ground plane 111 disposed the opposing (underside) surface of the dielectric substrate 109. The metallic shapes can be stripes as shown in FIGS. 1*a* and 2, or they can be slit squares as shown in FIG. 3. Other electrically conductive shapes can alternatively be utilized as the tensor impedance elements 106 if desired. A ground potential associated with front-end electronics 105 is coupled with the ground plane 111 on bottom side of the dielectric substrate 109. The SWGs 101, 102 should preferably be spaced apart a sufficient distance so that the fields adjacent the SWGs do not couple with each other. In practice the separation distance between SWGs 101, 102 is preferably at least ¼λ.

The tensor impedance elements 106 can be provided by metallic stripes disposed on a top side of the dielectric substrate 109 where the tensor impedance elements 106 in one channel are angled preferably at +45° with respect to the x axis, and the tilt angle of the stripes in the other channel is set to −45° with respect to that same axis. This variation in tilt angle produces radiation of different linear polarization, that when combined with a 90° phase shift via the 90° hybrid 103, produces circularly polarized radiation in transmit mode or allow reception of circularly polarized radiation in receive mode. The impedance elements could also be square patches with slices through them as described in B. Fong et al, "*Scalar and Tensor Holographic Artificial Impedance Surfaces*", noted above. Such an embodiment is depicted by FIG. 3.

The dielectric substrate 109 may preferably be made from Printed Circuit Board (PCB) material which has a metallic conductor (such as copper) disposed preferably on both of its major surfaces, the metallic conductor on the top or upper surface being patterned using conventional PCB fabrication techniques to define the aforementioned tensor impedance elements 106 from the metallic conductor originally formed on the upper surface of the PCB. The metallic conductor formed on the lower surface of the PCB would then become the ground plane.

In transmit operation, the front-end electronics 105 sends two independent signals from its transmit channels (T1 and T2) to the transmit connections of the two TR switches 104. The TR switches 104 send the two transmit signals to ports A and B of the 90° hybrid coupler 103. If the voltages at ports A and B are $V_A$ and $V_B$, then the voltages $V_C$ and $V_D$ at ports C and D are $(iV_A+V_B)/\sqrt{2}$ and $(V_A+iV_B)/\sqrt{2}$, respectively where $i=\sqrt{-1}$ and represents a 90° phase shift.

The signals from ports C and D of the 90° hybrid coupler 103 pass through optional coaxial cables 110 to end launch Printed Circuit Board (PCB) connectors 107 which are connected to surface-wave (SW) feeds 108. The coaxial cables 110 and connectors 107 may be omitted if coupler 103 is connected directly the SW feeds 108, for example. If coaxial cables 110 are utilized, then their respective center conductors are connected to the SW feeds 108 while their shielding conductors are connected to the ground plane 111. Instead of using coaxial cables 110 to connect outputs of the coupler 103 to the feeds 108, a link between the two can alternatively be provided by rectangular waveguides, microstrips, coplanar waveguides (CPWs), etc. The SW feeds 108 preferably have a 50 Ω impedance at the end that connects to coupler 103 via the end-launch connector 107 (if utilized). The SW feed 108 flares from one end, preferably in an exponential curve, until its width matches the width of the SWGs 101, 102. The SW feeds 108 launch surface waves with a uniform field across their wide ends into the SWGs 101, 102. The SW feeds 108 are preferably formed using the same techniques to form the tensor impedance elements 106 (this is, by forming them from them the metallic conductor found on a typical PCB). The widths of the SWGs 101, 102 is preferably between ⅛ to 2 wavelengths of an operational frequency (or frequencies) of the SWGs 102, 102.

The SWGs 101, 102 are preferably composed of a series of metallic tensor impedance elements 106 whose sides are preferably angled at ±45° or having angled slices as in the embodiment of FIG. 3 with respect to the SWG axis (the x-axis in FIG. 1) as noted above. The slices are angled at ±45° with respect to the major axis of the SWGs 101, 102 axis so that the polarization angle of each SWG is aligned with its slices. It should be noted that series of metallic tensor impedance elements 106 with angled slices or sides could be angled at some other angle than ±45° with respect to the SWG axis (the x-axis in FIG. 1), but in that case the hybrid coupler 103 has to have a phase shift that is different from 90 degrees at its outputs. Such a hybrid coupler 103 is not believed to be commercially available, so it would be a custom designed coupler, but such a coupler could designed and made if desired. So the angles of ±45° with respect to the SWG axis (the x-axis in FIG. 1) set for the angles of the metallic tensor impedance elements 106 (or the angles of the slices or sides of the as in the embodiment of FIG. 3) is preferred as those angles are believed to be compatible with commercially available hybrid couplers for element 103.

The widths of the individual metallic tensor impedance elements 106 are typically much narrower than the widths of the SWGs 101, 102 which they form. In FIG. 1 the widths of the individual metallic tensor impedance elements 106 averages about ⅐th of the width of the SWGs 101, 102. Typically, the individual metallic tensor impedance elements 106 will be spaced by 1/20 to 1/5 of a wavelength apart from each other along the length of the SWGs 101, 102. The width of the individual metallic tensor impedance elements 106 determines the SW propagation impedance locally along the SWG. The width of the tensor impedance elements 106 varies with distance along the SWG such that the SW impedance is modulated according to equation (Eqn. 2), in order to have the radiation pattern directed at an angle θ determined by equation (Eqn. 3) with respect to the z axis in the x-z plane noted on FIG. 1. This variation in the widths of the tensor impedance elements 106 can be seen in FIG. 1 as a noticeable moire pattern caused by the changing widths of the tensor impedance elements 106. This pattern repeats itself continuously along the length of the SWG, no matter how long the SWG is. The length of the SWG 101, 102 will depend on a number of factors related to the antenna's engineering parameters, such as desired radiation beam width, gain, instantaneous bandwidth, aperture efficiency, etc. Typically the length of the SWGs 101, 102 will fall in the range of 2 to 30 wavelengths at the operational frequency of the SWGs 101, 102.

The relation between the impedance-element geometry (e.g. the strip width) and the SW impedance is well understood. See the papers by Patel, Sievenpiper, Colburn, Fong and Gregoire identified above.

The metallic tensor impedance elements 106 in SWG 101 are angled in a direction opposite to the tensor impedance elements 106 in the other SWG 102. The radiation from the two SWGs will be polarized in the direction across the gaps between the strips. Therefore, the radiation from the two SWGs 101, 102 depicted by FIG. 1 will be orthogonal to each other. When the 90° phase shift difference is applied to the feeds 108 with the hybrid power splitter 103, the net radiation from the combination of the two SWGs 101, 102 is circularly polarized. However, as noted above other angles (than45°)for the metallic tensor impedance elements 106 relative to the x-axis can be utilized if a custom designed coupler 103 is employed and still the resulting polarization will be polar.

The radiation from each SWG 101, 102 is polarized as it is because the slanted metallic strips are tensor impedance elements 106 whose major principal axis is perpendicular to the long edge of the strips and the minor axis is along them. The local tensor admittance of the SWG in the coordinate frame of the principal axes is $$Y_{sw} = \begin{bmatrix} Y(x) & 0 \\ 0 & 0 \end{bmatrix}$$

where Y(x) is determined by the voltage applied to the metallic strips at position x. Then the SW current is $$J_{sw} = Y_{sw}E_{sw} = \begin{bmatrix} Y(x) & 0 \\ 0 & 0 \end{bmatrix} E_{sw} \begin{bmatrix} 1 \\ 1 \end{bmatrix} \Big/ \sqrt{2} = E_{sw} \Big/ \sqrt{2} \begin{bmatrix} 1 \\ 0 \end{bmatrix}$$

which is along the major principal axis that is perpendicular to the long edge of the strips forming the tensor impedance elements 106. The radiation is driven by the SW currents according to $$E_{rad} \propto [\int [\{\hat{k} \times J_{sw}\} \times \hat{k}] e^{-ik \cdot r'} dx] e^{ik \cdot r}$$

and is therefore polarized in the direction across the gaps between the strips.

The preferred embodiment for a 12 GHz version of a radiating element of the invention is shown in FIG. 1. Everything is scaled to a free-space wavelength at 12 GHz is $\lambda_0$=2.5 cm≅1.0". The SWGs 101 and 102 are preferably ½$\lambda_0$ wide. The exponentially-tapered, surface-wave feeds 108 are preferably 2$\lambda_0$ long. The period of the tensor impedance elements 106≅1/12 $\lambda_0$.

FIG. 2 illustrates a preferred embodiment where an RF feed assembly 108 is also disposed at the other of the SWGs with RF terminators 201 attached to the end. This prevents the surface-wave from reflecting off the end of the AISA which could lead to unwanted distortion in the radiation pattern.

This concludes the description of embodiments of the present invention. The foregoing description of these embodiments and the methods of making same has been presented for the purposes of illustration and description. It is not intended to be exhaustive or to limit the invention to the precise form or methods disclosed. Many modifications and variations are possible in light of the above teachings. It is intended that the scope of the invention be limited not by this detailed description, but rather by the claims appended hereto.

What is claimed is:

1. A dual-polarization, circularly-polarized artificial-impedance-surface antenna comprising:

(1) two adjacent tensor surface-wave waveguides (SWGs);

(2) two waveguide feeds, one of said waveguide feeds being coupled to each of the two SWGs;

(3) a hybrid coupler having output ports, each output port of the hybrid coupler being connected to one of the waveguide feeds, the hybrid coupler, in use, combining the signals from input ports of the hybrid coupler with phase shifts at its output ports.

2. The antenna of claim 1 wherein the SWGs are disposed on a common substrate.

3. The antenna of claim 2 wherein the SWGs polarization is rotated 90° with respect to each other and wherein the hybrid coupler is a 90° hybrid coupler.

4. The antenna of claim 2 wherein the SWGs include metallic strips or patches disposed in an elongated array on a top surface of a dielectric sheet, the dielectric sheet having a ground plane on a bottom surface thereof.

5. The antenna of claim 2 wherein the SWGs are elongated and each have a width which is between 1/8 to 2 wavelengths of an operational frequency of the SWGs and have a length which is between 2 and 30 wavelengths of said operational frequency of the SWGs.

6. The antenna of claim 5 wherein each of the SWGs comprises metallic strips slanted at an angle with respect a common direction of elongation of the SWGs.

7. The antenna of claim 6 wherein said metallic strips are disposed at 45° angle with respect to said common direction of elongation of the SWGs.

8. The antenna of claim 7 wherein said metallic strips in one SWG are disposed at 90° angle with respect said metallic strips in the other SWG.

9. The antenna of claim 4 wherein said metallic strips or patches are arranged in repeating patterns of varying thicknesses or sizes distributed along a length of each SWG.

10. The antenna of claim 1 wherein the SWGs include impedance elements that are spaced with a period of 1/20 to 1/5 wavelength apart from each other along the length of the SWG.

11. The antenna of claim 1 wherein the surface impedance tensor produces a modulated impedance pattern.

12. The antenna of claim 1 wherein the SWGs include impedance elements that are formed by metallic patches with slices through them and wherein said slices are angled at 45° with respect to a major axis of the SWGs so as to form an impedance tensor for each SWG having a polarization which is aligned with said slices.

13. A method of simultaneously transmitting two oppositely handed circularly polarized RF signals comprising the steps of:

i. providing a dielectric surface with a pair of elongate artificial impedance surface antennas, each of said artificial impedance surface antennas including a pattern of metallic geometric stripes or shapes disposed on said dielectric surface for guiding surface waves on said dielectric surface, the metallic geometric stripes or shapes having varying sizes which form a repeating pattern of said varying sizes, the repeating pattern of the each of said pair of elongate artificial impedance surface antennas having an angular relationship with reference to a major axis of said pair of elongate artificial impedance surface antennas, a first one of said pair of elongate artificial impedance surface antennas having a positive angular relationship to said major axis and second one of said pair of elongate artificial impedance surface antennas having a negative angular relationship to said major axis; and ii. applying RF energy to said pair of elongate artificial impedance surface antennas, said RF energy applied to said pair of elongate artificial impedance surface antennas forms RF waves that travel as surface waves on said dielectric surface signals and leave said surface as an RF emission having different relative phases selected such that the RF emission transmitted by said pair of elongate artificial impedance surface antennas are simultaneously both left handed circularly polarized and right handed circularly polarized.

14. The method of claim 13 wherein the repeating pattern of said varying sizes has a 45 degree angular relationship with reference to the major axis, one of the repeating patterns having a positive 45 degree angular relationship with reference to the major axis and the other one of the repeating patterns having a negative 45 degree angular relationship with reference to the major axis and wherein the phase of RF energy applied to said pair of elongate artificial impedance surface antennas has a relative 90° phase difference.

15. A method of simultaneously receiving two oppositely handed circularly polarized RF signals comprising the steps of:

(i) sending the signals received by two SWGs into two input ports of a 3 dB 90 degree hybrid coupler, the coupler also having two output ports, the two SWGs being defined in a single sheet of printed circuit board material; and (ii) extracting LHCP and RHCP signals from the output two ports of the hybrid coupler.

16. The antenna of claim 1 wherein the waveguide feeds each flares from a relatively narrow portion thereof which is coupled with said hybrid coupler to a relatively wide portion thereof, the relatively wide portion of each of said waveguide feeds mating with only one of said SWGs.

17. The antenna of claim 16 wherein each waveguide feeds flares in a curve until its width matches a width of the SWG to which it is mated.

18. The antenna of claim 17 wherein the curve is an exponential curve.

19. An antenna comprising:

two surface-wave waveguides (SWGs) defined in a single sheet of printed circuit board material;

two waveguide feeds defined in said single sheet of printed circuit board material, the two waveguide feeds each having (i) a wider end which is coupled to one of the two SWGs and (ii) a narrower end.

20. The antenna of claim 19 wherein each of the two SWGs comprise an elongated two dimensional array of metallic elements, the metallic elements each having a length and a width, the width of the metallic elements varying along a length of the elongated array of metallic elements in a repeating pattern of width variations.

21. The antenna of claim 20 wherein the lengths of the elongated array of metallic elements remain constant along the length of the elongated array of metallic elements.

22. The antenna of claim 21 wherein the lengths of the metallic elements of one of the SWGs are arranged at a 45° angle to the length of the elongated array of metallic elements while the lengths of the metallic elements of the other one of the SWGs are arranged at a 90° angle to the metallic elements of the one of the SWGs.

23. The antenna of claim 22 wherein the two waveguide feeds each flares from the narrower end thereof which is coupled with a hybrid coupler to the wider end which is coupled to one of the SWGs.

24. The antenna of claim 23 wherein each waveguide feeds flares in a curve until its width matches a width of the SWG to which it is coupled.

25. The antenna of claim 24 wherein the curve is an exponential curve.

26. The antenna of claim 1 wherein the two adjacent tensor surface-wave waveguides (SWGs) have a surface impedance tensor which varies sinusoidally along a major axis thereof.

27. The antenna of claim 26 wherein the SWGs each include metallic strips or patches disposed in an elongated array on a top surface of a dielectric sheet, the metallic strips or patches varying in size along said major axis in order to form said surface impedance tensor.

28. The antenna of claim 26 wherein the SWGs each include metallic patches disposed in a two dimensional array of rows and columns on a top surface of a dielectric sheet, each metallic patch having a width and a height, the metallic patches in the rows of said array varying in width along said major axis in order to form said surface impedance tensor while the metallic patches in each column of said two dimensional array remaining unchanged in height.

29. The antenna of claim 15 wherein the two phase-related ports of the hybrid coupler are phase-related to each other by ninety degrees of phase.

30. A method of simultaneously transmitting two oppositely handed circularly polarized RF signals comprising the steps of:

(i) applying LHCP RF signals to be transmitted to a first input port of a 3 dB 90 degree hybrid coupler and applying RHCP RF signals to be transmitted to a second input port of the coupler, the coupler also having two output ports; and (ii) coupling a signal at a first one of said output ports to one of two SWGs and coupling a signal at a second one of said output ports to the other one of two SWGs, the two SWGs being defined in a single sheet of printed circuit board material, the single sheet of printed circuit board material having a ground plane disposed at least under said two SWGs.

31. The method of claim 30 wherein the two SWGs are polarized at 90 degrees with respect to one another.

32. The method of claim 31 wherein the SWGs each include metallic strips or patches disposed in an elongated array on a top surface of a dielectric sheet, the method further including varying the metallic strips or patches in size along said major axis in order to form a sinusoidally varying surface impedance tensor.

33. The method of claim 31 wherein the SWGs each include metallic patches disposed in a two dimensional array of rows and columns on a top surface of a dielectric sheet, each metallic patch having a width and a height, the method including varying a width of the metallic patches in the rows of said array along a major axis of each SWG in order to form a sinusoidally varying surface impedance tensor while the metallic patches in each column of said two dimensional array remain unchanged in height.

34. The antenna of claim 11 wherein the modulated impedance pattern is according to $$Z(x)=X+M\cos(2\pi x/p)$$

where p is the period of the modulation, X is the mean impedance, and M is the modulation amplitude. X, M and p can be tuned such that the angle of the radiation θ in the x-z plane with respect to the z axis is scanned according to $$\theta=\sin^{-1}(n_0-\lambda_0/p)$$

where $n_0$ is the mean SW index, and $\lambda_0$ is the free-space wavelength of radiation and $n_0$ is related to Z(x) by $$n_0=\frac{1}{p}\int_0^p\sqrt{1+Z(x)^2}\,dx\approx\sqrt{1+X^2}.$$

* * * * *